US006392556B2

(12) United States Patent
Tomich

(10) Patent No.: US 6,392,556 B2
(45) Date of Patent: May 21, 2002

(54) CHAIR TILT ALARM

(76) Inventor: David Christopher Tomich, 14 Willowby Way, Lynnfield, MA (US) 01940

( * ) Notice: Subject to any disclaimer, the term of this patent is extended or adjusted under 35 U.S.C. 154(b) by 0 days.

(21) Appl. No.: 09/761,978

(22) Filed: Jan. 17, 2001

Related U.S. Application Data

(60) Provisional application No. 60/176,672, filed on Jan. 18, 2000.

(51) Int. Cl.[7] ..... G08B 21/00

(52) U.S. Cl. ..... 340/689; 340/686.1; 340/573.1; 340/671

(58) Field of Search ..... 340/689, 686.1, 340/687, 573.7, 671, 573.1

(56) References Cited

U.S. PATENT DOCUMENTS

| | | | | |
|---|---|---|---|---|
| 2,713,159 A | | 7/1955 | Morrison | |
| 2,754,497 A | | 7/1956 | Wolpert | |
| 3,076,186 A | | 1/1963 | Greene | |
| 5,123,495 A | * | 6/1992 | Littlejohn et al. | 364/424.05 |
| 5,297,021 A | * | 3/1994 | Koerlin et al. | 364/167.01 |
| 5,528,219 A | * | 6/1996 | Frohlich et al. | 340/540 |
| 5,853,219 A | | 12/1998 | Santuccio | |
| 5,890,869 A | * | 4/1999 | Iemaster et al. | 414/678 |
| 5,926,099 A | | 7/1999 | Unum | |
| 6,154,690 A | * | 11/2000 | Coleman | 701/29 |

FOREIGN PATENT DOCUMENTS

JP 411169407 A * 6/1999

* cited by examiner

*Primary Examiner*—Jeffery Hofsass
*Assistant Examiner*—Daniel Previl
(74) *Attorney, Agent, or Firm*—Mark P. White

(57) ABSTRACT

The chair tilt alarm 10 comprises a power supply 12 in electrical communication with an on-off switch 14, a tilt sensor 16, and an warning device 18. The warning device 18 will be activated when the chair 20 is tilted beyond a predetermined angular position 22. As the chair returns toward its righted position, the alarm will deactivate. The chair tilt alarm 10 can be shut off manually or remotely. The chair tilt alarm (10) is also equipped with data storage and transmission modules for reporting of chair tilting at a base station. The chair tilt alarm (10) is also equipped with a counter-balance system to correct the chair to an acceptable position.

16 Claims, 12 Drawing Sheets

CHAIR TILT ALARM

CROSS REFERENCES TO RELATED APPLICATIONS

Provisional Patent Application No. 60/176,672, filed Jan. 18, 2000.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to the arts of warning a chair occupant that the chair is tilted beyond a predetermined angle, correcting a chair tilted beyond the predetermined angle to an acceptable position, and storing the history of a chair tilting beyond the predetermined angle.

BACKGROUND—DESCRIPTION OF PRIOR ART

People, especially children, have a natural tendency to tilt back or side-to-side in their chairs. The consequences for tilting the chair beyond a safe inclination angle are personal injury to the person in the chair and possibly others in the close proximity when the chair supports are no longer in stable contact with the floor and the chair falls. This hazardous situation exists for tiltable chairs as well as non-tiltable. Even tiltable chairs are designed for a safe inclination angle beyond which may result in the chair tipping over. There is also a possibility that the chair may be damaged as a result of the fall or by the increased stresses on the legs designed for all legs to be on the floor or within a predetermined angular position at all times.

There has been a long-felt need for an inexpensive, reliable way to prevent accidents due to chairs, especially chairs not intended to be tilted, herein referred to as non-tiltable chairs, tipping over. Previous chair innovations have focused on inventing tiltable chairs to make tilting safe, but not on monitoring systems to warn of tilting or to correct the chair to avoid tipping. Even the tiltable chair innovations do not eliminate the possibility of a tiltable chair from tipping over.

The natural tendency to tilt has been addressed by chair prior art with independent tilting mechanisms that allow the chair legs to remain in contact with the floor as the individual tilts back. However, it is costly to replace non-tiltable chairs with new tiltable chairs, and nearly impossible to retrofit a tilting mechanism onto a non-tiltable chair. School districts, for example, cannot justify the expense to replace functional non-tiltable chairs with new or retrofitted tiltable chairs. Also, children in the class may be distracted by the constant rocking motion of the tiltable chairs, thereby, creating a new problem for teachers. As stated above, even the tiltable chair innovations do not eliminate the possibility of a tiltable chair from tipping over. None of the chair prior art totally addresses the problem of tilting safety in chairs.

The prior art search was extended beyond the Chair and Seat Classification (Class 297) to Tent Canopy, Umbrella & Cane (Class 135), Electricity: circuit and breakers (Class 200), and Communications: Electrical (Class 340), as well as numerous keyword searches. Many tilt alarms have been patented ranging from vehicle tilt alarms (U.S. Pat. No. 4,956,629) to walker imbalance alarms (U.S. Pat. No. 5,511,571) to walker tilt alarms (U.S. Pat. No. 5,853,219) to toilet seat lift alarms (U.S. Pat. No. 5,926,099). These patents disclose a mercury switch or the like to activate a signal when an electrical circuit is closed due to inclination or load change of the subject item. However, these prior art references are from different fields and contain no suggestions, either expressed or implied, that the references should be combined with a chair to create the present invention.

The present invention solves the unrecognized problem of how to monitor chair tilting, warn the user of unsafe conditions, and to help correct the chair to an acceptable position. The present invention provides an advantage (increased user safety) that was never before appreciated, and is the solution of long-felt need for an inexpensive, reliable way to help prevent accidents due to chairs tipping over.

BRIEF SUMMARY OF THE INVENTION

The present invention relates to a chair tilt alarm comprising a switch with a movable conductive member that indicates inclination beyond a fixed angle and an alarm that alerts people, especially children, that the chair is tilted beyond a safe position. Such a device has beneficial applications in schools as well as in the home and in offices.

The gravity-actuated switch, embodied in the case attached to the chair bottom closes the electric circuit causing a transducer to produce a tilt sensor signal to indicate that a chair is inclined beyond a safe position.

The present invention comprises a power supply in electrical communication with an on-off switch, a tilt sensor, and an alarm. The alarm will be activated when the chair is tilted beyond a predetermined angular position. As the chair returns toward its righted position, the alarm will deactivate. The present invention can be shut off manually or remotely.

The alarm will emit sound, light, touch, scent or a combination to stimulate any or all of the user's senses. An audio alarm can be in the form of a pre-recorded message to correct the chair. The audio alarm can also be a simple steady or intermittent tone, where the period between tones can vary and the volume of the tone can increase the longer the chair is in the undesirable tilted position. A visual alarm will use the same principles as the audio alarm where a light can be steady or intermittent like a strobe light. The intensity of the light and flashing period can be amplified the longer the chair is in the undesirable tilted position. Some embodiments can employ other known devices similar to the audio and visual devices emitting a local touch or scent to get the attention of the user. The variety of warning devices will accommodate the diverse student population with physical limitations such as hearing and vision.

Additional embodiments include data storage and transmission modules for reporting of chair tilting at a base station, and a counter-balance system to correct the chair to an acceptable position.

The present invention solves the unrecognized problem of how to monitor chair tilting and warn the user of an unsafe condition. The present invention provides an advantage (increased user safety) that was never before appreciated, and is the solution of long-felt need for an inexpensive, reliable way to help prevent accidents due to chairs tipping over.

The present invention also relates to other structures that would benefit from monitoring angular position.

It is an object of the present invention to provide a chair tilt alarm that is low cost.

It is another object of the invention to provide a chair tilt alarm that is attached easily to any chair (tiltable as well as non-tiltable chairs).

It is another object of the invention to provide a chair tilt alarm that is easy to use.

It is another object of the invention to provide a chair tilt alarm that is low maintenance.

It is another object of the invention to provide a chair tilt alarm that is durable and reliable to warn the user of unsafe conditions.

It is another object of the invention to provide a chair tilt alarm that is inconspicuous.

It is another object of the invention to provide a chair tilt alarm that reports to a base station significant parameters regarding chair tilt angle, chair identification, occupant identification, time, date, and duration.

It is another object of the invention to provide a chair tilt alarm that helps to correct the angle of the chair with a counter-balance system.

Still further objects and advantages will become apparent from a consideration of the ensuing description and accompanying drawings.

PREFERRED EMBODIMENT—DESCRIPTION

Figure 1:
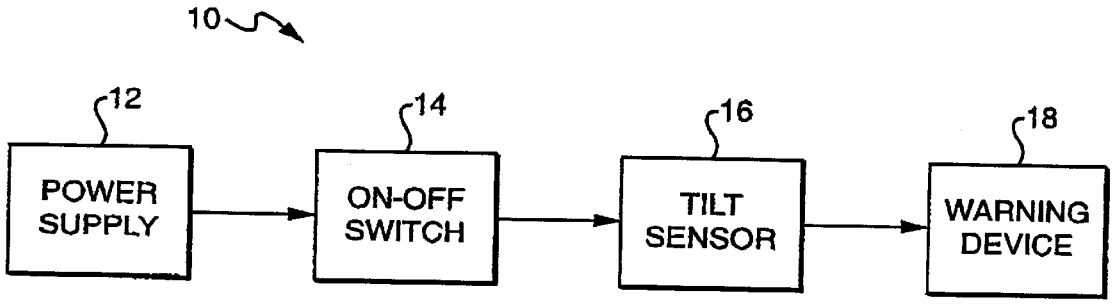
FIG. 1 is a block diagram of the chair tilt alarm components
Figure 2:
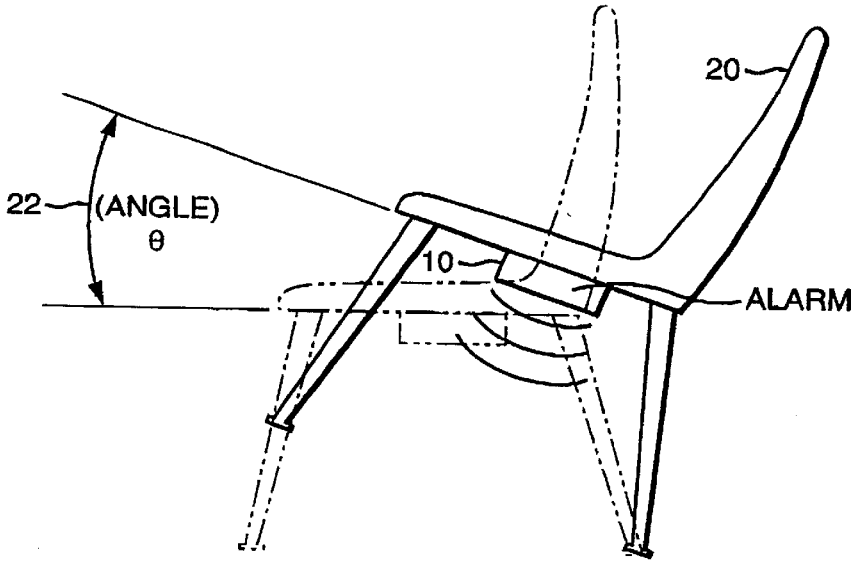
FIG. 2 is a side view of the operation of the chair tilt alarm

The chair tilt alarm 10 comprises an electrical circuitry having a power supply 12 in communication with an on-off switch 14, a tilt sensor 16, and an warning device 18, as shown in FIG. 1. The warning device 18 will be activated when the chair 20 is tilted beyond a predetermined angular position 22, as shown in FIG. 2. The warning device 18 will automatically shut off when the chair 20 is returned toward its righted position.

Figure 3A:
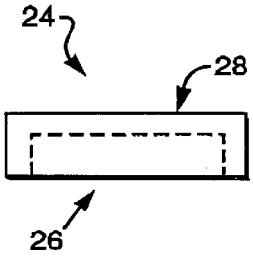
FIG. 3*a* is a side view of the compact case top lid
Figure 3C:
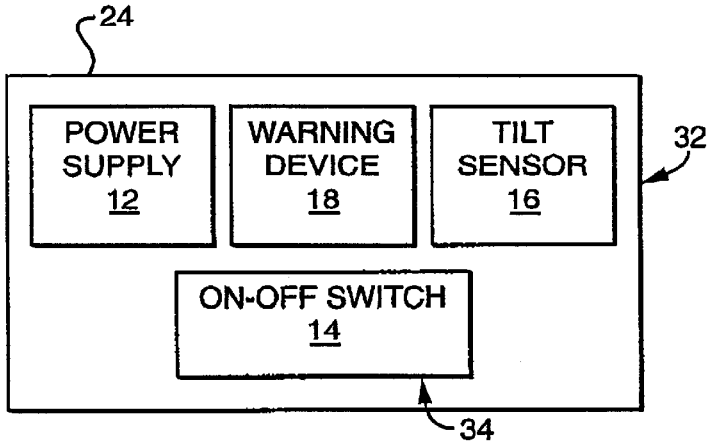
FIG. 3*c* is a top view of the chair tilt alarm components in the compact case bottom lid
Figure 3B:
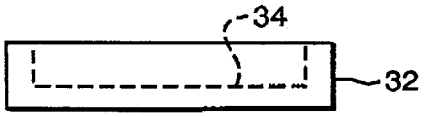
FIG. 3*b* is a side view of the compact case bottom lid

The components of the chair tilt alarm 10 are housed in a compact case 24 that comprises a top lid 26 with outer surface 28, as shown in FIG. 3A, and a base lid 32 with inner surface 34, as shown in FIG. 3B. The compact case 24 top lid 26 and base lid 32 are removably coupled for maintenance purposes. The power supply 12, on-off switch 14, tilt sensor 16, and warning device 18 are attached to compact case 24 base lid 32 inner surface 34 for ease of maintenance, as shown in FIG. 3C.

Figure 4:
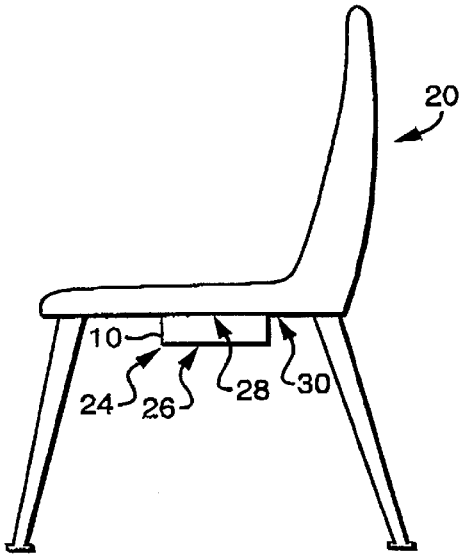
FIG. 4 shows a side view of the chair tilt alarm attached to a chair
Figure 5A:
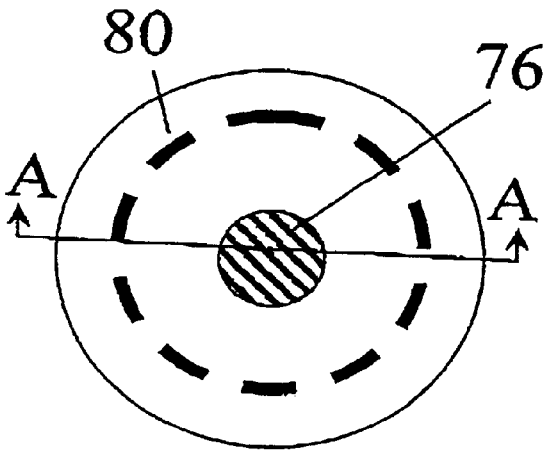
FIG. 5A is a top view of a bowl-shaped tilt sensor in a level position
Figure 5B:
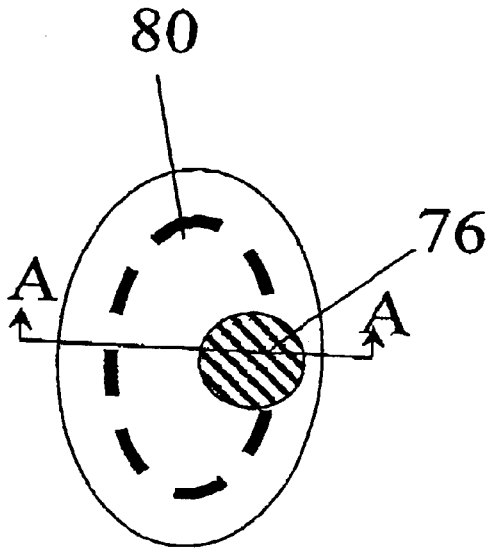
FIG. 5B is a top view of a bowl-shaped tilt sensor in a tilted position
Figure 5C:
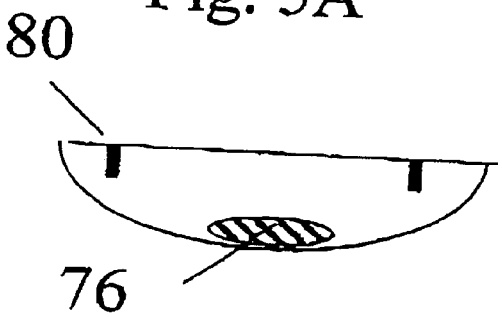
FIG. 5C is a view of cross section A—A of a bowl-shaped tilt sensor in a level position
Figure 5D:
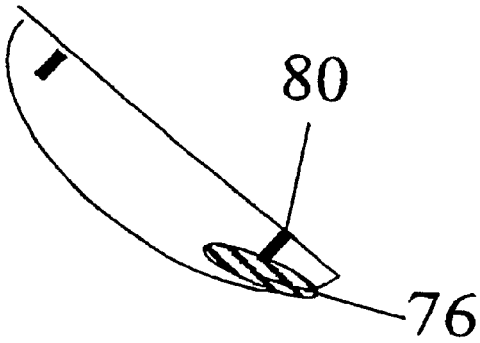
FIG. 5D is a view of cross section A—A of a bowl-shaped tilt sensor in a tilted position

As shown in FIG. 4, the compact case 24 top lid 26 outer surface 28 is attached to the chair bottom surface 30 with adhesive, screws, nails, hook & eye device, or other attachment systems to secure the chair tilt alarm 10 to the chair bottom surface 30 under normal operating conditions. The compact case 24 can be fitted with a lock (not shown) to provide a tamper resistant function so unauthorized people cannot damage or modify the system. The lock can be a combination, key, or other locking mechanism that will facilitate ease of maintenance (e.g., battery replacement). The preferred embodiment shows the chair tilt alarm 10 fixedly attached to the chair bottom surface 30, however, one skilled in the arts may, with very little experimentation, develop an alternative attachment system that positions the chair tilt alarm 10 at other chair locations.

The preferred embodiment utilizes a battery as the power supply 12. The power supply 12 is in electrical communication with a positive terminal (not shown) and a negative terminal (not shown) connected to the electrical circuitry. However, one skilled in the art of power supplies may, with little experimentation, develop other power sources, such as solar, to generate low voltage at low cost for a longer period.

The preferred embodiment tilt sensor 16 comprises a switch containing a movable conductive member 76, such as mercury, with single-axis or multi-axis capability that closes the electric circuit when the chair tilt angle exceeds the predetermined angular position 22, thereby, activating the warning device 18. FIGS. 5A, 5B, 5C and 5D illustrate a bowl-shape switch 78 comprising a series of electrodes 80 that will close the circuit to the warning device 18 when the movable conductive member 76 comes in contact with 2 or more electrodes 80. The switch 78 may be of a type shown in U.S. Pat. No. 2,713,159 or commercially available from manufacturers such as Spectron Sensors, Clino Ltd, Applied Geomechanics, Inc., Comus International, Rodale, Mercury Switches, Inc. and Dana American Electronic Components.

The preferred embodiment warning device 18 is programmable and emits a tone or buzz. The audio alarm can be a simple steady or intermittent tone, where the period between tones of the intermittent tone can vary and the volume of the tone can increase the longer the chair is in the undesirable tilted position. The volume and time period of tone, if intermittent mode selected, will be programmed to alert but not startle, thereby, avoiding an accident resulting from the frightened user. An audio alarm can also be in the form of a pre-recorded message requesting the user correct the chair angle. The warning devices and operating software are commercially available, and can be customized by one skilled in the art.

Alternative warning devices (not shown) will be equipped with a bright light, or with touch and scent emitting units. A visual alarm will use the same principles as the audio alarm, where a light that will be programmable to illuminate constantly or at a phased period, like a strobe light. The intensity of the light can be amplified or reduced and flashing period shortened the longer the chair is in the undesirable tilted position. Other alternative alarms comprise touch or scent or a combination to stimulate one or more of the user's senses. The touch device emits a pulse and scent device emits a noticeable fragrance, both sufficient for a user to recognize the warning and take corrective action. The variety of warning devices will accommodate the diverse population of users with limitations such as hearing and vision. These devices are commercially available and one skilled in the art can customize the components for the desired warning results.

Figure 6:
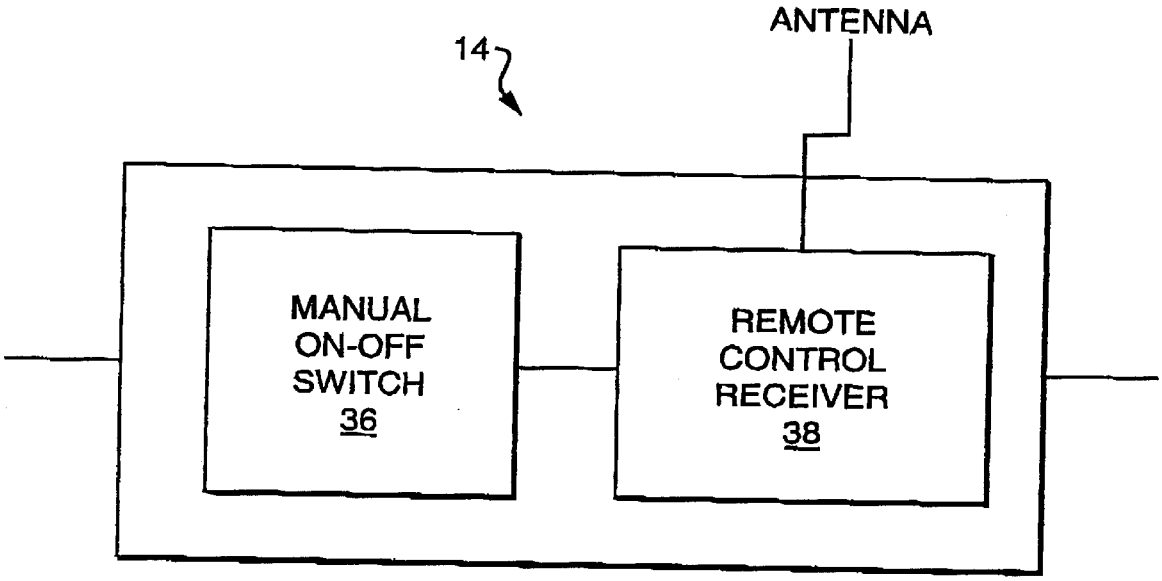
FIG. 6 is an illustration of the components of the on-off switch
Figure 7:
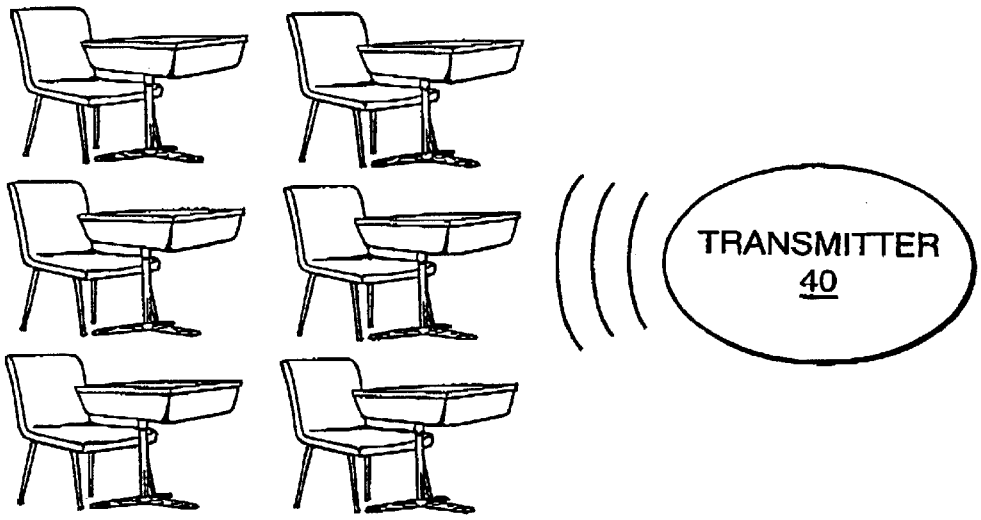
FIG. 7 is an illustration of the remote control activation system

The on-off switch 14 comprises a manual on-off switch 36 in electrical communication with a remote control receiver 38, as shown in FIG. 6. The manual on-off switch 36 can be push-button, key activated, toggle or the like accessible through an orifice (not shown) in the chair tilt alarm 10 base lid 32. The remote control receiver 38 communicates with a transmitter 40, as shown in FIG. 7. The remote control receiver 38 and transmitter 40 can be set to a common frequency so one transmitter 40 can control more than one chair tilt alarm 10, or one unique remote control receiver 38 for every transmitter 40. The remote function is important where chairs are frequently placed upside-down on desks when cleaning floors. The repeated activation of the warning device 18 would be disturbing to those frequently exposed to the alarm. The manual-switch, remote control receiver and transmitter are commercially available and programmable for customization by one skilled in the art.

Figure 8A:
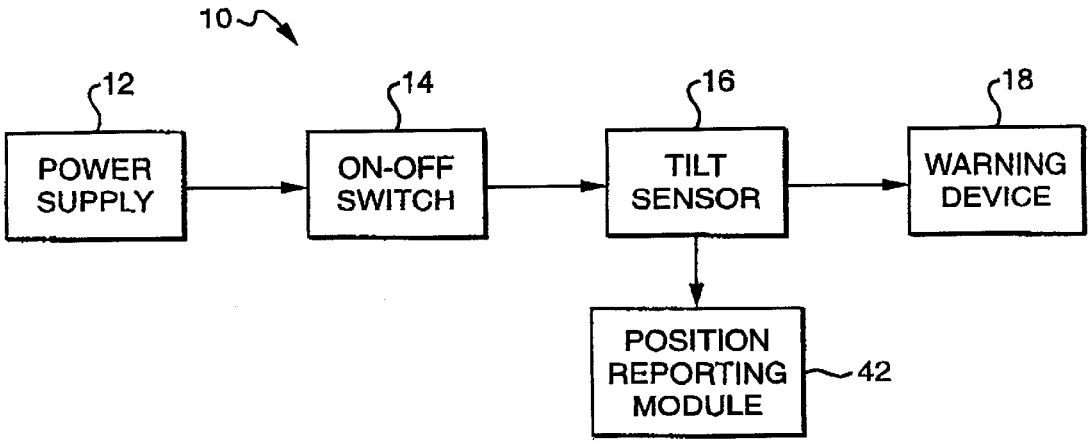
FIG. 8A is a block diagram of the electrical communication of the preferred embodiment with the position reporting module
Figure 8B:
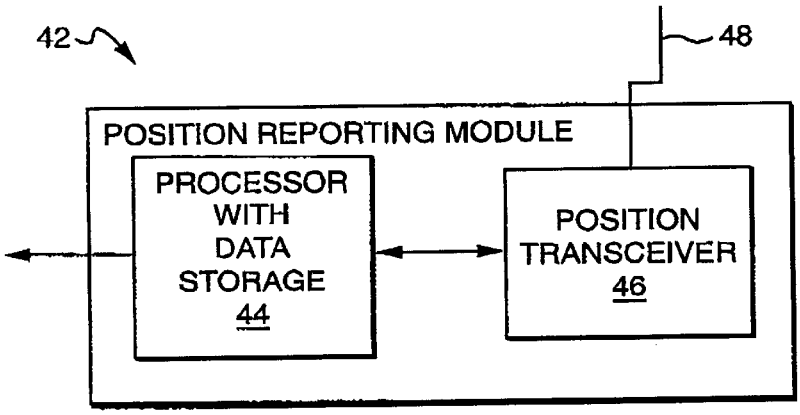
FIG. 8B shows the components of the position-reporting module
Figure 8C:
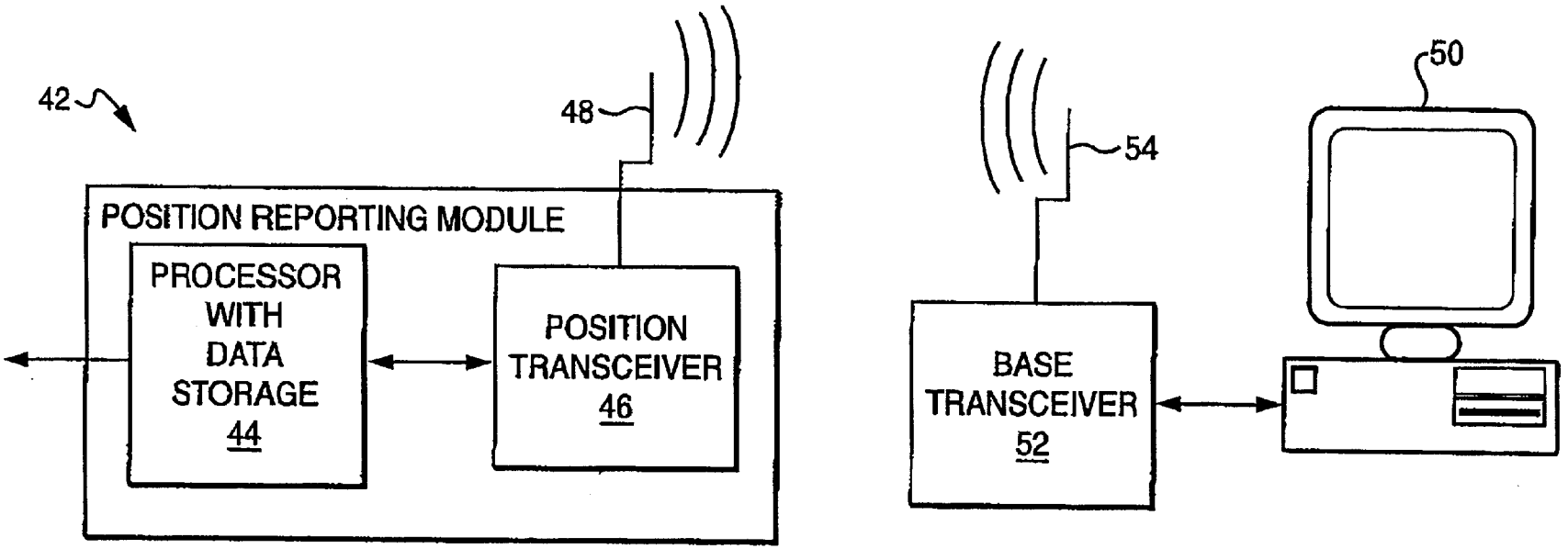
FIG. 8C is an illustration of the position reporting module in electrical communication with a base station

As illustrated in FIGS. 8A, 8B, and 8C, an alternative embodiment includes a position-reporting module 42 in electrical communication with the tilt sensor 16 to transmit the chair angular position 22 to a base station 50 having a data base. The position-reporting module 42 is programmable having a processor with data storage 44 for record keeping of the chair position. The position data is collected when the angular position 22 exceeds predetermined limits. Each position-reporting module data record (not shown) includes a module identification number for cross-referencing to a chair or to an occupant. The position-reporting module 42 further comprises a position transceiver 46 and a transceiver antenna 48 to transmit position data upon command to a base station 50, having a base transceiver 52 with a base antenna 54, or at a predetermined time interval or when the predetermined angular position is exceeded. The position transceiver 46 and base transceiver 52 are combinations of radio wave or microwave frequency receivers and transmitters within one device. The base station 50 is preferably a personal computer with a processor, memory, and input and output devices. The personal computer also includes data base management software for storage, retrieval and reporting purposes. The data collected and maintained in the database include not only angular position 22, but also includes data such as the position-reporting module identification number, chair identification number, classroom, occupant assigned to chair, teacher, date, time, duration, and number of times the chair exceeded predetermined limits. The hardware described above are commercially available. The database and system software can be purchased commercially and can be customized by one skilled in the art.

Figure 9A:
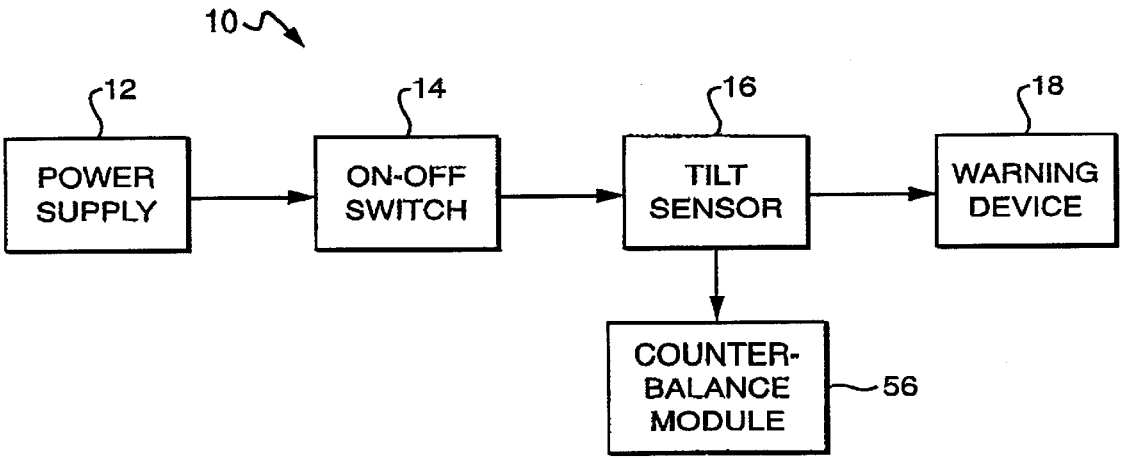
FIG. 9A is a block diagram of the electrical communication of the preferred embodiment with the counter-balance module
Figure 9B:
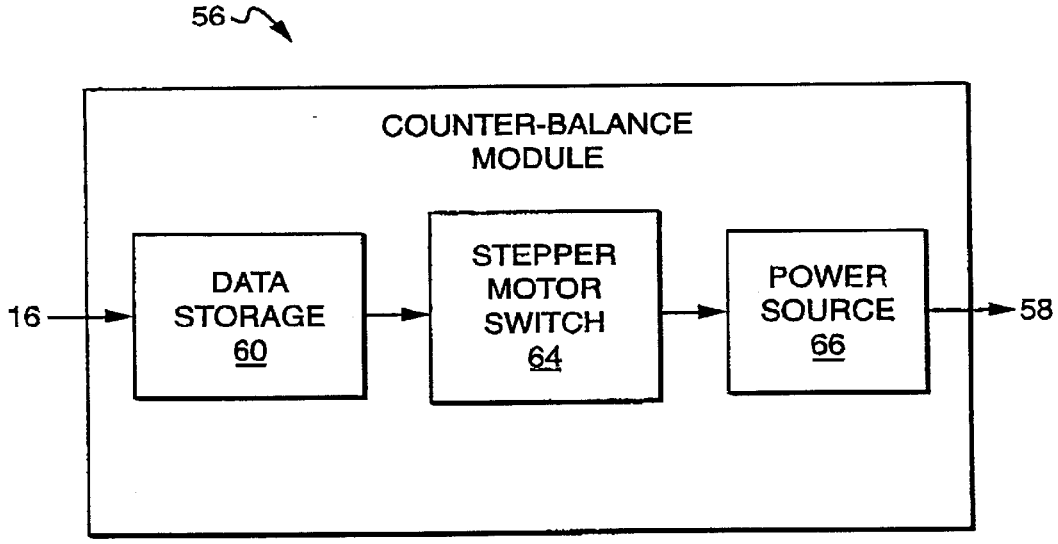
FIG. 9B is an illustration of the single-axis counter-balance module components

As illustrated in FIGS. 9A and 9B, an alternative embodiment includes a counter-balance module 56 in electrical communication with the tilt sensor 16 to transmit the angular position 22 to a counter-balance system 58. The counter-balance module 56 comprises a processor with data storage 60, a stepper motor switch 64, and a plurality of power source terminals (not shown) to connect a power source 66. The processor with data storage 60 receives the angular position 22 and computes the counter weight 62 (to be discussed below) coordinates, in machine interpreted steps, to help adjust the tilting chair back to its level position. The processor with data storage 60 will translate the correction coordinates in motor steps. A correction signal, containing the correction coordinates, sent from the processor with data storage 60 closes the stepper motor switch 64 and transmits the correction coordinates to the stepper motor 68. Thereby, a stepper motor 68 is powered by the power source 66, preferably a battery, increments the motor 68 for the predetermined number of motor steps, and advances the counter weight 62 to the predetermined position to help force all chair supports to the floor.

Figure 10A:
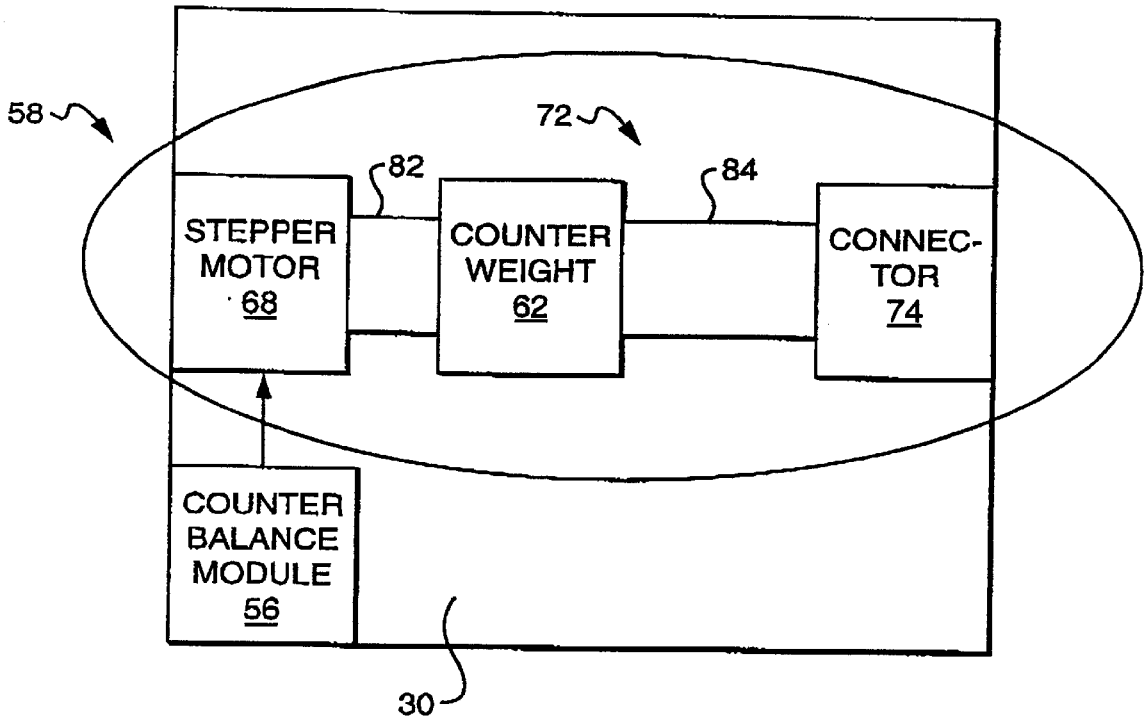
FIG. 10A is a bottom view of a single-axis conveyor belt counter-balance system
Figure 10B:
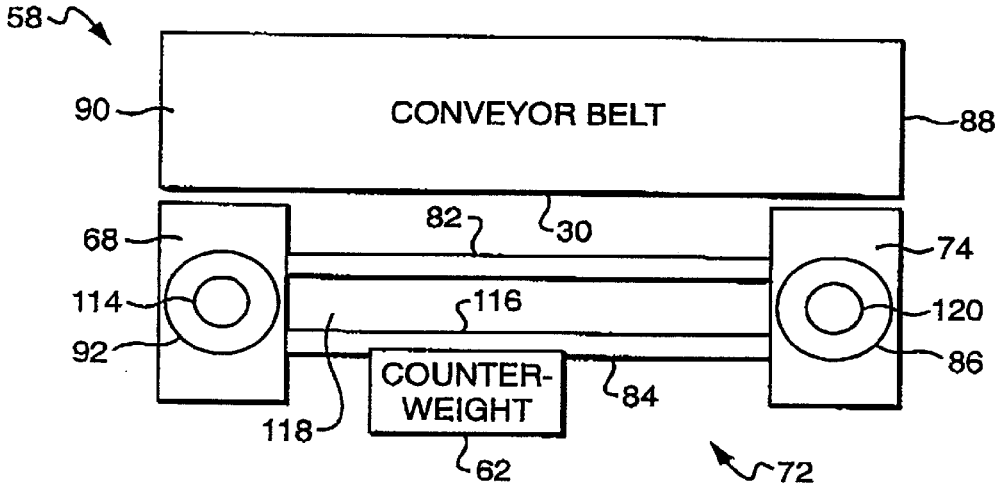
FIG. 10B is a side view of a single-axis conveyor belt counter-balance system

As illustrated in FIG. 10A and FIG. 10B, the preferred counter-balance embodiment 58 comprises a counter weight 62, a stepper motor 68, a linkage 72, and a connector 74. The preferable linkage 72 is a conveyor belt 82 with an outer surface 84 and an inner surface 116. A counter weight 62 is fixedly attached to the conveyor belt outer surface 84. The connector 74 includes a freely rotatable roller 86 and the stepper motor 68 includes a rotatably coupled propulsion roller 92 to hold the conveyor belt 82 in position at opposing ends of the chair bottom surface 30. The connector 74 is attached to the first end 88 of the bottom surface of the chair. The rollers are positioned within the conveyor belt perimeter 118. The conveyor belt 82 is frictional held in position by the propulsion roller outer diameter 114, which is rotatably coupled to the stepper motor 68 at the chair bottom surface second end 90, and the freely rotatable rotor outer diameter 120. Preferably, the first 88 and second 90 ends are the front and back of the chair, respectively, but it is foreseeable that a counter-balance system can also operate with a counter weight 62 moving from side-to-side. The stepper motor 68 will advance or reverse the conveyor belt 82, thereby positioning the counter weight 62 in the appropriate position to either bring the front or rear legs of the chair down to the floor. Once the actual chair angle is below the predetermined angle, the processor with data storage 60 can be programmed to send a correction signal to the stepper motor 68 to position the counter weight 62 in the center of the chair. The counter balance mechanism 58 is sized in length to attach to the chair bottom surface 30 between the first 88 and second 90 ends of the chair. The conveyor belt 82 is sized for the chair and counter weight 62.

Figure 11A:
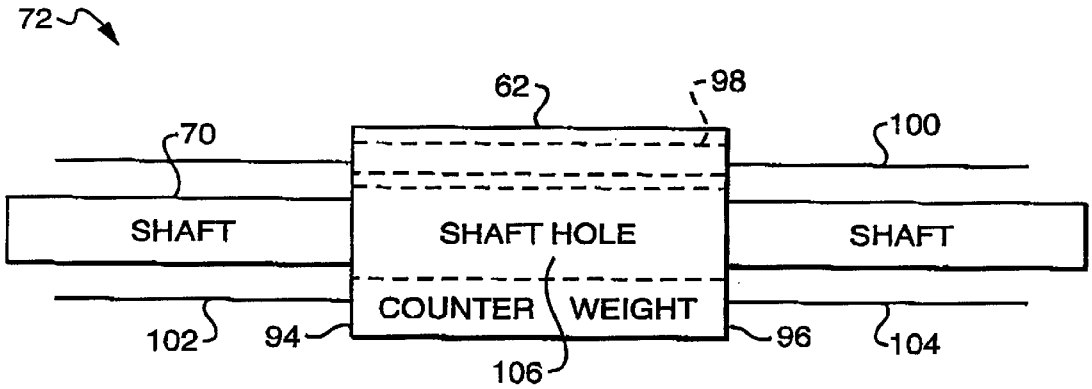
FIG. 11A is an illustration of a counter weight in a pulley and cable linkage system
Figure 11B:
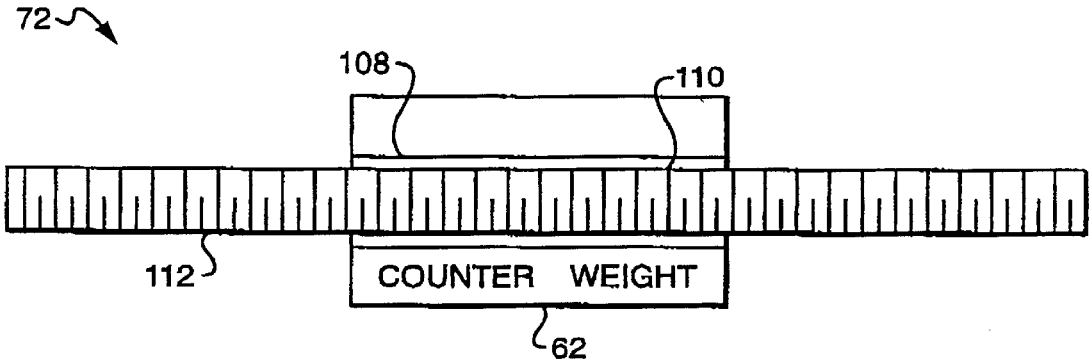
FIG. 11B is an illustration of a counter weight in a threaded shaft linkage system

Alternatives to a conveyor belt linkage system include pulley/cable and threaded shaft systems. FIGS. 11A and 11B illustrate the counter weight 62 attachment to the alternative systems. A counter weight 62, having a first surface 94 and a second surface 96, is common among the linkage systems.

The differences are the counter weight attachment and method of positioning the counter weight 62. In a pulley/cable linkage system, the conveyor belt rollers, 86, 92, are replaced with pulleys (not shown) and the counter weight 62 includes a cable position hole 98, which is sufficiently sized so a cable 100 can freely travel through the hole 98. A single cable 100 with two ends, first cable end 102, second cable end 104, is threaded through the first pulley, the cable position hole 98, and the second pulley. The cable ends, 102, 104, are fixedly attached to the first surface 94 and the second surface 96 of the counter weight 62, respectively. The counter weight 62 also includes a shaft hole 106 through the center of the counter weight 62 from the first surface 94 to the second surface 96. The shaft hole 106 is sufficiently sized to receive the shaft 70 so that the counter weight 62 will travel freely as the stepper motor 68 advances or reverses the cable 100. The connector 74 (as shown in FIG. 10A) will house the freely rotatable pulley (not shown) and one end of the shaft 70 (not shown) will be fixedly attached to the connector 74.

In a threaded shaft linkage system (FIG. 11B), the counter weight 62 only includes an internally threaded shaft hole 108 through the center of the counter weight 62 from the first surface 94 to the second surface 96. The threaded shaft hole 108 is sufficiently sized with internal threads 110 to receive the externally threaded shaft 112. The externally threaded shaft 112, having opposing ends (not shown), is fixedly coupled to the stepper motor shaft (not shown) at one end. Since the counter weight 62 is constrained by the chair bottom surface 30, the counter weight 62 will not rotate as the stepper motor 68 rotates the threaded shaft 112. Therefore, the counter weight 62 will travel forward or backward as the stepper motor 68 advances or reverses, thereby, positioning the counter weight 62 appropriately. The connector 74 (as shown in FIG. 10A) will house a receptacle (not shown) to hold the rotating threaded shaft 112 opposing end. Since the threaded shaft 112 is rotatably, the preferred receptacle will contain bearings (not shown) or the like for smooth operation.

Figure 12A:
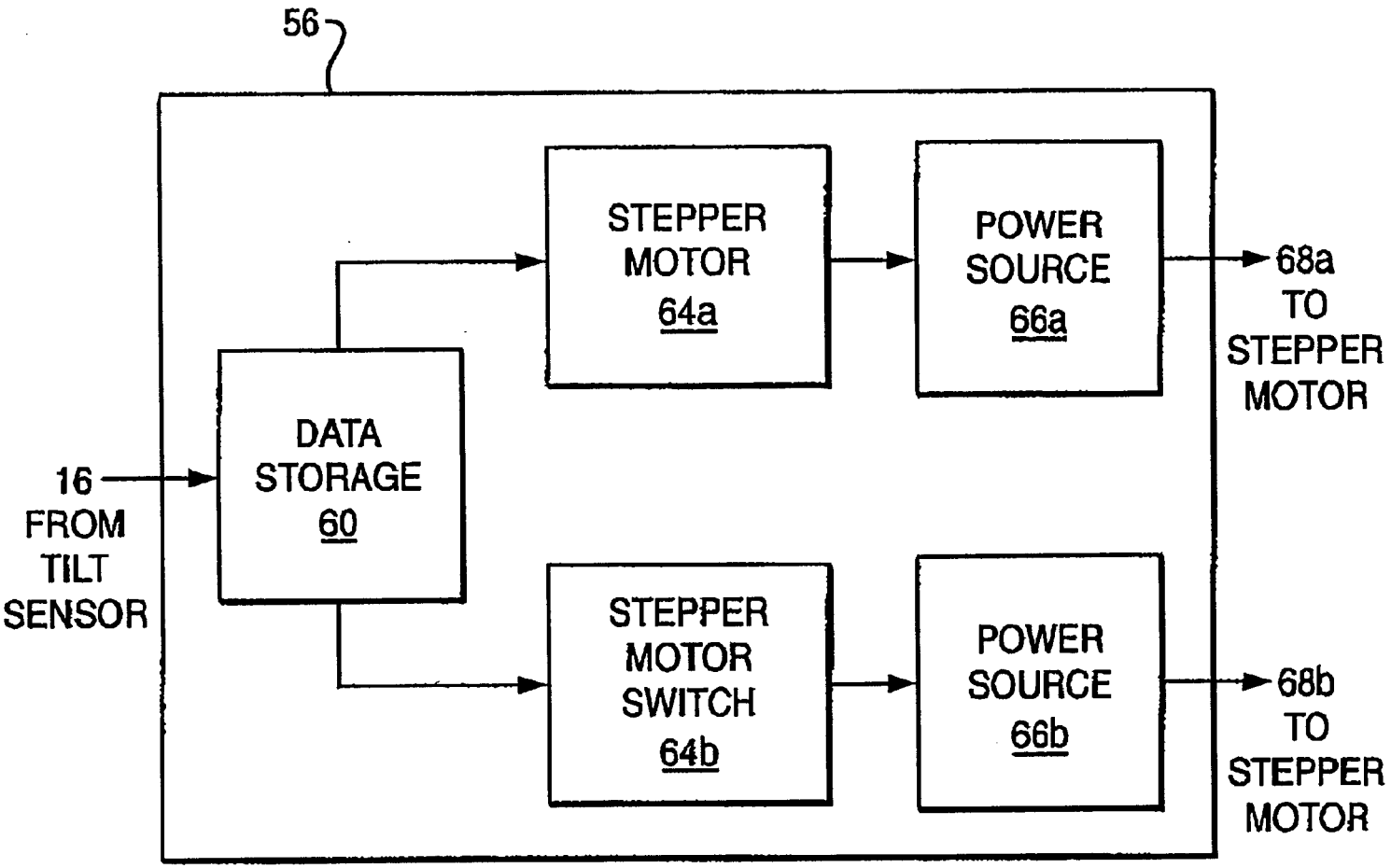
FIG. 12A is an illustration of the dual-axis counter-balance module components
Figure 12B:
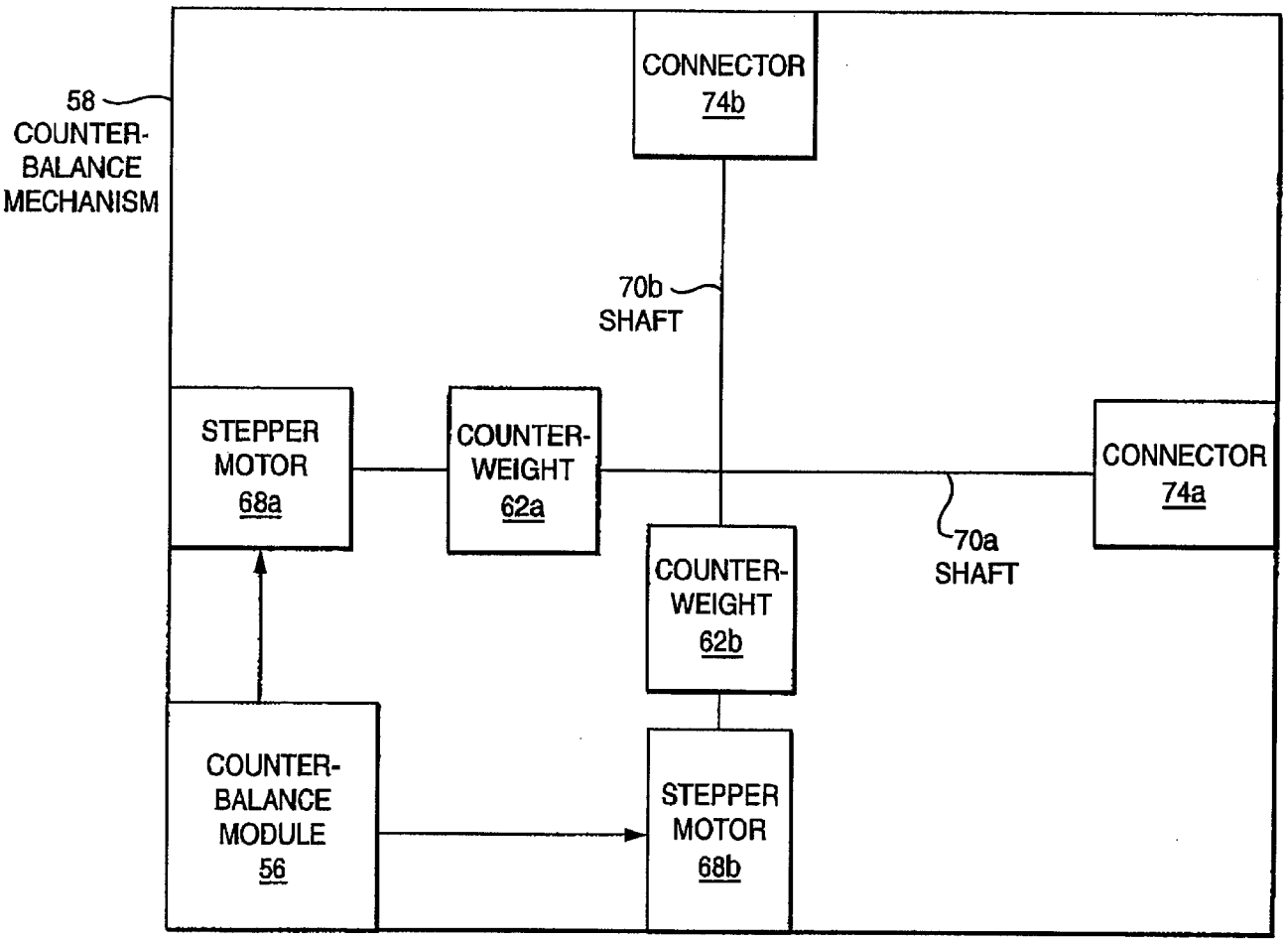
FIG. 12B is an illustration of a horizontal dual-axis counter-balance system
Figure 12C:
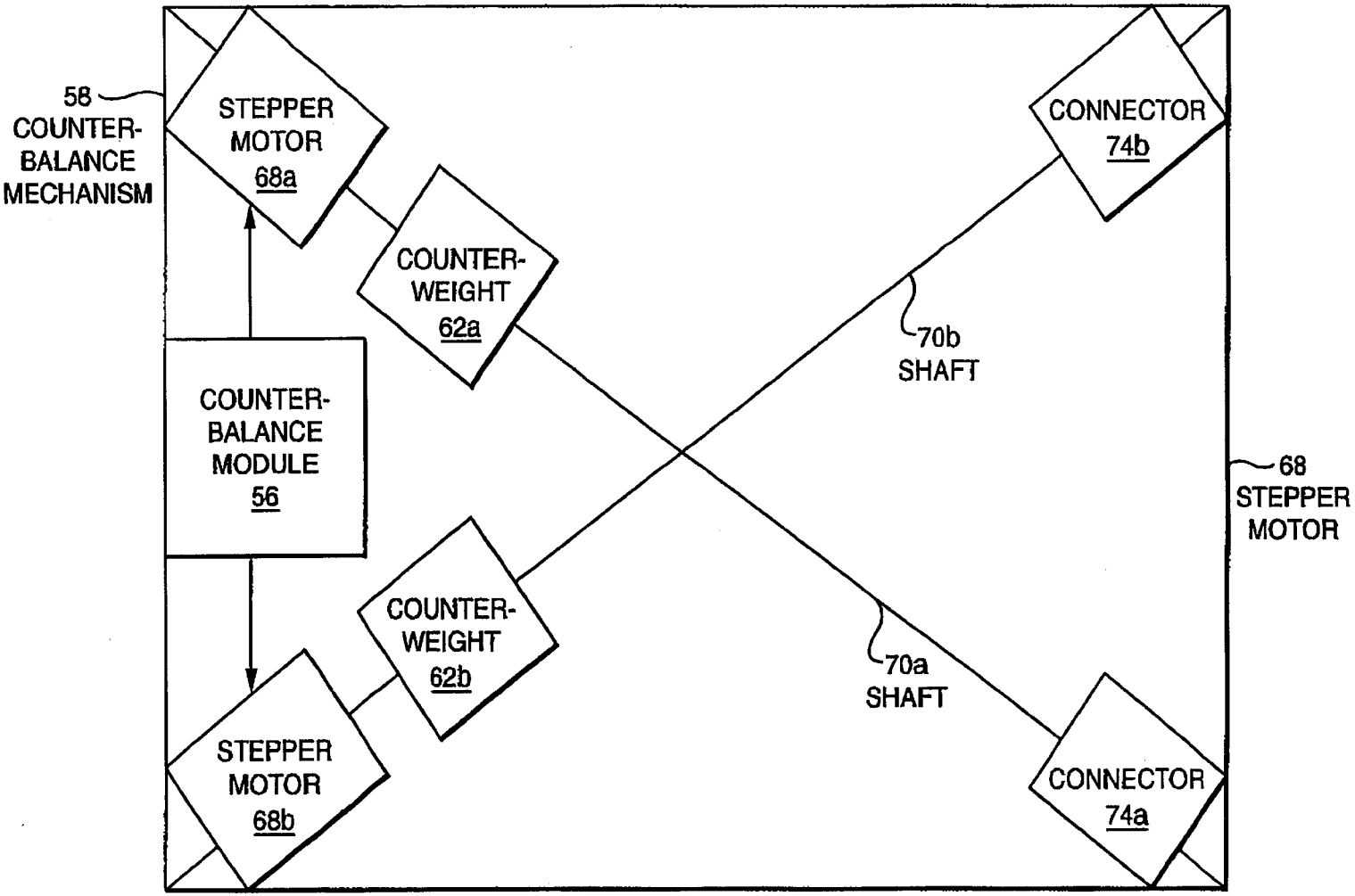
FIG. 12C is an illustration of a vertical dual-axis counter-balance system

Alternatives to a single counter weight system are illustrated in FIGS. 12A, 12B and 12C, examples of a dual-axis counter-balance systems. A dual-axis counter balance system has the benefit over the single-axis system of positioning the counter weight to correct the chair for side-to-side tilting as well as front-to-back tilting. Basically, the same elements as the single-axis system are doubled and positioned so not to interfere with the operation of the cooperating linkage system. The orientation of the shaft 70 can be horizontal and vertical, as illustrated in FIG. 12B, or diagonal, as illustrated in FIG. 12C. One skilled in the art can to appropriate orientation with little experimentation.

Notwithstanding the above descriptions, any commercially available counter-balancing system and operating software are also adequate and within the scope of the present invention.

Accordingly, it can be seen that the chair tilt alarm 10 solves the unrecognized problem of how to monitor chair tilting, warn the user of an unsafe condition, and correct for the imbalance. The present invention provides an advantage (increased user safety) that was never before appreciated, and is the solution of long-felt need for an inexpensive, reliable way to prevent accidents due to chairs tipping over. The present invention has applications for non-tiltable chairs, tiltable chairs and other structures that would benefit from monitoring of an angular position.

Although the description above contains many specificities, these should not be construed as limiting the scope of the invention but as merely providing illustrations of some of the presently preferred embodiments of this invention. The scope of the invention should be determined by the claims and their legal equivalents, rather than by the examples given.

I claim:

1. An automatically actuatable safety chair-tilt alarm to warn a user of dangerous surface tipping being attached to a chair with a bottom surface, a first end, and a second end comprising:

(a) an electrical circuitry having a warning device and a tilt sensor in electrical series, wherein the tilt sensor signal includes an angular position of the chair bottom surface, and wherein the tilt sensor sends a tilt sensor signal to the warning device when the chair is tipped from a level position beyond a predetermined angular position with respect to the chair bottom surface, wherein the warning device sends a warning signal to warn the user in response to the tilt sensor signal;

(b) means for connecting the electrical circuitry to a power source, the connecting means having a plurality of terminals including at least one positive terminal and at least one negative terminal;

(c) a base station;

(d) a base transceiver, having a base antenna, in communication with the base station; and (e) a position-reporting module in communication with the tilt sensor and the base station, the position-reporting module transmits to the base station data, contained within the tilt sensor signal, received from the tilt sensor; whereby the tilt alarm is arranged to actuate when the chair is beyond design safety limits, the data, such as chair angular position, chair number, classroom, occupant assigned to chair, teacher, date, time, duration and number of times the chair exceeded predetermined limits, is retained by the base station for future retrieval and reporting, and whereby the tilt alarm is arranged to actuate when the chair is beyond design safety limits.

2. The safety chair-tilt alarm as recited in claim 1, wherein the position-reporting module comprises:

(a) a programmable processor, having a data storage unit to store the data, contained within the tilt sensor signal, received from the tilt sensor; and (b) a position transceiver, having a position transceiver antenna, in communication with the programmable processor, wherein the position transceiver transmits the data received by the programmable processor to the base station upon a command by the base station or at a predetermined time interval or when the angular position of the chair bottom surface exceeds the predetermined angular position, whereby the data is stored at the base station for future analysis.

3. An automatically actuatable safety chair-tilt alarm to warn a user of dangerous surface tipping being attached to a chair with a bottom surface, a first end, and a second end comprising:

(a) an electrical circuitry having a warning device and a tilt sensor in electrical series, wherein the tilt sensor sends a tilt sensor signal to the warning device when the chair is tipped from a level position beyond a predetermined angular position with respect to the chair bottom surface, wherein the tilt sensor signal includes an angular position of the chair bottom surface, and wherein the warning device sends a warning signal to warn the user in response to the tilt sensor signal; (b)

means for connecting the electrical circuitry to a power source, the connecting means having a plurality of terminals including at least one positive terminal and at least one negative terminal; and (c) a counter-balance system in communication with the tilt sensor, the counter-balance system having a processor with data storage in communication with at least one counter weight having a first and a second surface, the counter-balance system further comprising:

(a) a stepper motor in communication with the processor to receive the correction coordinates for positioning the counter weight;

(b) at least one linkage coupling the stepper motor and the counter weight; and (c) a correction signal sent by the processor containing the counter weight correction coordinates activating the stepper motor, wherein the conveyor belt advances and the counter weight positions;

wherein the processor translates the angular position of the chair bottom surface received from the tilt sensor into a plurality of correction coordinates for positioning the counter weight, wherein the counter weight is actuated to the correction coordinates, whereby the chair is corrected to an acceptable angular position, and whereby the tilt alarm is arranged to actuate when the chair is beyond design safety limits.

4. The safety chair-tilt alarm as recited in claim 3, wherein the linkage includes a conveyer belt, having a perimeter and an inner surface, and a plurality of rollers, having an outer diameter, the counter weight being fixedly attached to the conveyor belt, the rollers being positioned within the conveyor belt perimeter, wherein the roller outer diameters are in frictional contact with the conveyor belt inner surface, the rollers being positioned between the first and the second ends of the chair to hold the conveyor belt in position parallel to the chair bottom surface, wherein at least one roller is rotatably coupled to the stepper motor.

5. The safety chair-tilt alarm as recited in claim 3, wherein the linkage includes:

(a) a plurality of pulleys, wherein one pulley is rotatably coupled to the stepper motor;

(b) the counter weight having a cable position hole; and (c) a cable having two ends, wherein the cable is threaded through the pulleys and the cable position hole and fixedly attached to the counter weight.

6. The safety chair-tilt alarm as recited in claim 3, wherein the linkage includes:

(a) the stepper motor having a shaft;

(b) an externally threaded shaft, having opposing ends, wherein one end is fixedly coupled to the stepper motor shaft; and (c) an internally threaded shaft hole through the center of the counterweight from the first surface to the second surface, wherein the threaded shaft hole is sufficiently sized with internal threads to receive the externally threaded shaft.

7. A method of providing a safety chair-tilt alarm for a chair with a bottom surface, a first end, and a second end, comprising the steps of:

(a) connecting a tilt sensor to the chair bottom surface together with a plurality of power supply terminals in communication with a warning device;

(b) attaching an on/off switch to the tilt alarm so as to permit the tilt alarm to be deactivated when the chair is not in use;

(c) arranging the on/off switch to be actuated by a user of the chair to emit a tilt sensor signal when the chair is tilted to an angular position beyond a predetermined angular position;

(d) providing a counter-balance system in communication with the tilt sensor, the counter-balance system having a processor with data storage in communication with at least one counter weight having a first and a second surface, the processor translates the angular position received from the tilt sensor into a plurality of correction coordinates for positioning the counter weight, wherein providing the counter-balance system further comprises the steps of:

(i) providing a stepper motor in communication with the processor to drive the counter weight into position;

(ii) providing a linkage to couple the stepper motor and the counter weight; and (iii) providing a positive and a negative terminal to connect a power supply, the terminals being in communication with the processor and the stepper motor.

8. A method of providing a safety chair-tilt alarm for a chair as recited in claim 7, wherein the linkage further comprises the steps of:

(a) providing a conveyor belt, having a belt perimeter and an inner surface; and (b) providing a plurality of rollers having an outer diameter, the counter weight being fixedly attached to the conveyor belt, the rollers being positioned within the conveyor belt perimeter, wherein the roller outer diameter is in frictional contact with the conveyor belt inner surface, the rollers being positioned between the first and the second ends of the chair to hold the conveyor belt in position parallel to the chair bottom surface, wherein at least one roller is rotatably coupled to the stepper motor.

9. A method of providing a safety chair-tilt alarm for a chair as recited in claim 7, wherein the linkage further comprises the steps of:

(a) providing a plurality of pulleys, having one pulley rotatably coupled to the stepper motor;

(b) providing the counter weight having a cable position hole; and (c) providing a cable having two ends, wherein at least one cable end is threaded through the pulleys and the cable position hole, wherein both cable ends are fixedly attached to the counter weight.

10. A method of providing a safety chair-tilt alarm for a chair as recited in claim 7, wherein the linkage further comprises the steps of:

(a) providing the stepper motor having a shaft;

(b) providing an externally threaded shaft, having opposing ends, one end fixedly coupled to the stepper motor shaft; and (c) providing an internally threaded shaft hole through the center of the counter weight from the first surface to the second surface, wherein the threaded shaft hole is sufficiently sized with internal threads to receive the externally threaded shaft.

11. An automatically actuatable safety chair-tilt alarm to warm a user of dangerous surface tipping being attached to a chair with a bottom surface, a first end, and a second end comprising:

(a) tilt sensing means for producing a tilt sensor signal, the tilt sensor signal including an angular position of the chair bottom surface, in response to the chair exceeding a predetermined angle position relative to a level surface;

(b) warning means for providing a warning signal to alert the user of the chair tilting beyond a predetermined angular position in response to the tilt sensing means signal, the warning means comprises an audio device further comprising a programmable function, to alert the user with a sound,; and (c) means for connecting tilt sensing means and the warning means to a power source;

wherein the audio device can be programmed for a simple steady or intermittent tone, the period between tones of the intermittent tone can vary and the volume of the tone can increase the longer the chair is in the underside tilted position, and wherein the audio device can also be in the form of a pre-recorded message requesting the user correct the chair angle, whereby the user is alerted but not startled, thereby, avoiding an accident resulting from a frightened user, so that the user is alerted to a potentially unsafe position and the tilt of the chair can be maintained approximately below the predetermined angular position.

12. An automatically actuatable safety chair-tilt alarm to warn a user of dangerous surface tipping being attached to a chair with a bottom surface, a first end, and a second end comprising:

(a) tilt sensing means for producing a tilt sensor signal, the tilt sensor signal including an angular position of the chair bottom surface, in response to the chair exceeding a predetermined angle position relative to a level surface;

(b) warning means for providing a warning signal to alert the user of the chair tilting beyond a predetermined angular position in response to the tilt sensing means signal, further comprising a visual device to alert the user with a light which comprises a programmable function, wherein the light can be programmed to illuminate constantly or at a phased period, like a strobe light wherein the intensity of the light can be intensified or reduced and said phased period shortened the longer the chair is in the undesirable tilted position, and (c) means for connecting tilt sensing means and the warning means to a power source;

whereby the user is alerted to a potentially unsafe position and the tilt of the chair can be maintained approximately below the predetermined angular position, the user being alerted but not startled, thereby avoiding an accident resulting from a frightened user.

13. An automatically actuatable safety chair-tilt alarm to warn a user of dangerous surface tipping being attached to a chair with a bottom surface, a first end, and a second end comprising:

(a) tilt sensing means for producing a tilt sensor signal, the tilt sensor signal including an angular position of the chair bottom surface, in response to the chair exceeding a predetermined angle position relative to a level surface;

(b) warning means for providing a warning signal to alert the user of the chair tilting beyond a predetermined angular position in response to the tilt sensing means signal; and (c) means for connecting tilt sensing means and the warning means to a power source;

(d) counter balance means for positioning at least one counter weight to a predetermined position to force the chair to the level surface in response to the tilt sensing means signal, the counterbalance further comprising (a) means for processing and storing data in communication with at least one counter weight, the processing means translates the angular position received by the tilt sensing means into a plurality of correction coordinates in terms of machine interpreted steps for positioning the counter weight;

(b) means, connected to the processing means, for driving the counter weight to the correction coordinates, the driver means will be incremented by the predetermined steps;

(c) means for linking the counter weight and the driver means; and (d) a plurality of power source terminals to connect a power source to the processing means and the driver means, whereby the chair is corrected to an acceptable position based on the tilt angle received by the tilt sensing means, and whereby the user is alerted to a potentially unsafe position and the tilt of the chair can be maintained approximately below the predetermined angular position.

14. The chair tilt alarm for a chair as recited in claim 13, wherein the linkage means comprises:

(a) a conveyor belt, having a perimeter and an inner surface, and a plurality of rollers, having an outer diameter, the counter weight being fixedly attached to the conveyor belt, the rollers being positioned within the conveyor belt perimeter, wherein the roller outer diameter is in frictional contact with the conveyor belt inner surface, the rollers being positioned between the first and the second ends of the chair to hold the conveyor belt in position parallel to the chair bottom surface, wherein at least one roller is rotatably coupled to the drive means; and (b) the processing means sends a correction signal containing the counter weight correction coordinates, activating the drive means, and advancing the conveyor belt, whereby the counter weight is positioned resulting in the lowering of the chair legs back to the floor.

15. The safety chair-tilt alarm as recited in claim 14, wherein the driver means is a stepper motor.

16. A method of providing a safety tilt-alarm for a chair comprising the steps of:

(a) sensing a tilt angle of the chair beyond a predetermined angular position; and (b) signaling the user of the chair that the chair is beyond the predetermined angular position, wherein the tilt alarm further comprises transmitting data to a base station for the storage, whereby the data, such as chair angular position, chair number, classroom, occupant assigned to chair, teacher, date, time, duration and number of times the chair exceeded predetermined angular position, is retained by the base station for future retrieval and reporting, whereby the user, now being aware that the chair is tilted beyond an acceptable angle, will lower the chair below the predetermined angular position, thereby deactivating the tilt alarm.

* * * * *